US005417000A

United States Patent [19]

Chen

[11] Patent Number: 5,417,000

[45] Date of Patent: May 23, 1995

[54] HANDGUN LOCK AND ALARM MEANS

[76] Inventor: Mike Chen, P.O. Box 55-1670, Taipei (104), Taiwan, Prov. of China

[21] Appl. No.: 301,637

[22] Filed: Sep. 7, 1994

[51] Int. Cl.[6] ..... F41A 17/46

[52] U.S. Cl. ..... 42/70.06

[58] Field of Search ..... 42/1.01, 70.06, 70.11

[56] References Cited

U.S. PATENT DOCUMENTS

| | | | |
|---|---|---|---|
| 1,686,482 | 10/1928 | Windle | 42/70.06 |
| 2,742,726 | 4/1956 | Feller | 42/70.06 |
| 4,739,569 | 4/1988 | Battle | 42/1.01 |
| 5,108,019 | 4/1992 | Woodward et al. | 224/243 |
| 5,191,158 | 3/1993 | Fuller et al. | 42/70.11 |
| 5,283,971 | 2/1994 | Fuller et al. | 42/70.11 |

*Primary Examiner*—Charles T. Jordan

*Assistant Examiner*—Theresa M. Wesson

[57] ABSTRACT

A handgun lock and alarm device including a lock body having a movable jaw portion pivotally mounted on the lock body and a fixed jaw portion, with the movable jaw portion and the fixed jaw portion defining a socket for engaging a trigger guard and shielding a trigger of the handgun for safety purposes; a shackle protruding transversely from the movable jaw portion, through an opening in the trigger guard beyond the trigger and into a shackle hole recessed in the fixed jaw portion to be normally locked by a latch held in the lock body for hanging the lock body on the trigger guard; and an alarm having a motion sensor mounted on the lock body, whereby upon moving and vibration of the motion sensor, the alarm will be actuated for warning purposes.

6 Claims, 3 Drawing Sheets

HANDGUN LOCK AND ALARM MEANS

BACKGROUND OF THE INVENTION

U.S. Pat. No. 5,108,019 to Woodward et al. discloses a mechanism for storing a hand gun and preventing its unauthorized use. A gun holster has a flexible strap that can be latched to the holster in a position extending over the hammer portion of the gun. When the strap is drawn away from the holster (prior to removal of the gun, an electrical circuit is broken, thereby triggering a battery-operated alarm on the holster. A key-operated lockout switch is provided to enable the gun owner to remove the gun without generating an alarm signal.

However, such a handgun safety device may have the following drawbacks:

1. The trigger (16) is not shielded, and an accidental triggering may still happen, even though the alarm is sounding, to possibly causing a shooting injury by the firing of the gun.

2. The alarm is merely actuated once opening the strap (19) of the holster (10). If a thief or burglar steals or robs the whole thing including the gun and the holster without removing the strap (19), the alarm will not be actuated losing its security meaning.

SUMMARY OF THE INVENTION

The object of the present invention is to provide a handgun lock and alarm device including; a lock body having a movable jaw portion pivotally mounted on the lock body and a fixed jaw portion, with the movable jaw portion and the fixed jaw portion defining a socket for engaging a trigger guard and shielding a trigger of the handgun for safety purposes, a shackle protruding transversely from the movable jaw portion, through an opening in the trigger guard beyond the trigger and into a shackle hole recessed in the fixed jaw portion to be normally locked by a latch held in the lock body for hanging the lock body on the trigger guard; and an alarm having a motion sensor mounted on the lock body, whereby upon vibration of the motion sensor such as taking the handgun, the alarm will be actuated for warning purposes.

DETAILED DESCRIPTION

Figure 1:
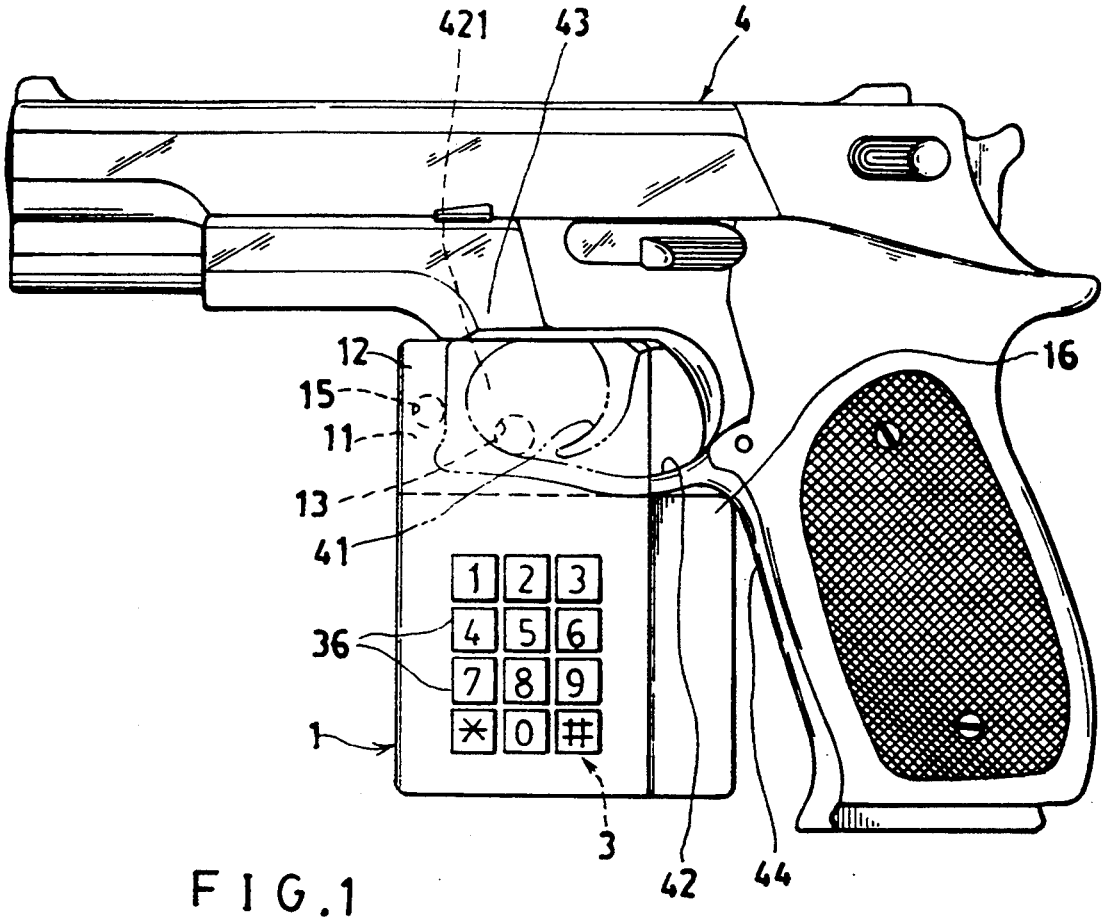
FIG. 1 is an illustration showing an assembled handgun in accordance with the present invention.
Figure 2:
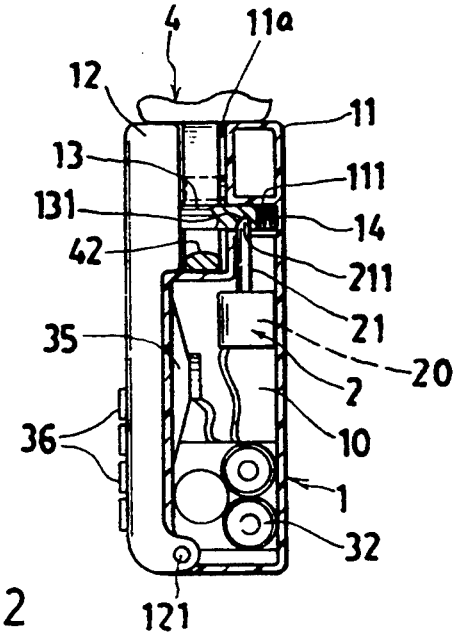
FIG. 2 is a partial longitudinal sectional drawing of the present invention.
Figure 3:
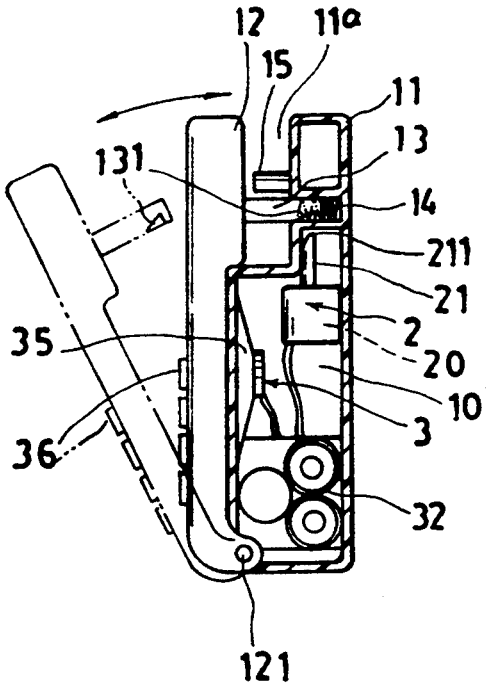
FIG. 3 shows a locking and unlocking condition of the present invention as shown in FIG. 2.

As shown in FIGS. 1–4, the present invention comprises: a lock body 1 hanged on a handgun 4, a locking device 2, and an alarm and control means 3. The handgun 4 is a conventional pistol having a trigger 41 pivotally confined within a trigger guard 42 formed between a barrel 43 and a handgrip 44 of the handgun 4.

The lock body 1 includes: a fixed jaw portion 11 protruding upwardly from a casing 10, having the locking device 2 and the alarm and control means 3 stored in the casing 10; a movable jaw portion 12 pivotally connected to the casing 10 by a pivot 121 and protruding upwardly from the casing 10 to be juxtapositional to the fixed jaw portion 11; a shackle 13 protruding transversely from the movable jaw portion 12 to be inserted into a shackle hole 111 recessed in the fixed jaw portion 11 by passing the shackle 13 through an opening 421 in the trigger guard 42 of the handgun 4 and beyond the trigger 41 for hanging the shackle 13 and the lock body 1 on the trigger guard 42; a socket 11*a* recessed and defined between the fixed jaw portion 11 and the movable jaw portion 12 and engaged with the trigger guard 42 to allow the fixed jaw portion 11 and the movable jaw portion 12 to shield the trigger guard 42 and the trigger 41 of the handgun 4 for preventing unwanted accidental actuation of the trigger 41 for safety purposes, a tension spring 14 retained in the shackle hole 111 in the fixed jaw portion 11 for tensioning the shackle 13 sidewardly for helping opening of the movable jaw portion 12 when unlocking the locking device 2; at least a limiting stem 15 protruding transversely from the fixed jaw portion 11 towards the movable jaw portion 12 and positioned at an outer end portion of the lock body 1 adjacent to the barrel 43 of the handgun 4 to retard a front end portion of the trigger guard 42 for preventing a forward sliding movement of the lock body 1 from unshielding of the trigger 41 and for precluding the intrusion of a kid's finger into the trigger guard 42; and a rear block portion 16 formed on a rear end portion of the casing 10 to be retained against the handgrip 44 to retard a rearward movement of the lock body 1 to prevent an unwanted triggering of the shackle 13 on the trigger 41 for safety purposes, especially for the safety of kids and innocent persons.

The locking device 2 includes: a locking mechanism 20 which may be a solenoid switch electrically connected to the alarm and control means 3 and mounted in the casing 10 of the lock body 1, and a latch 21 reciprocatively held in the locking mechanism 20 and having a latch end 211 engageable with the shackle notch 131 for locking the shackle 13 with the latch 21 for closing the movable jaw portion 12 to the fixed jaw portion 11 of the lock body 1 for shielding the trigger 41 and trigger guard 42 of the handgun 4, whereby upon energizing of the solenoid switch 20, the latch 21 will be electromagnetically attracted downwardly to disengage the latch end 211 from the shackle notch 131 and the tension spring 14 will bias the shackle 13 to open the movable jaw portion 12 for unlocking the handgun 4 for possible triggering use.

Figure 4:
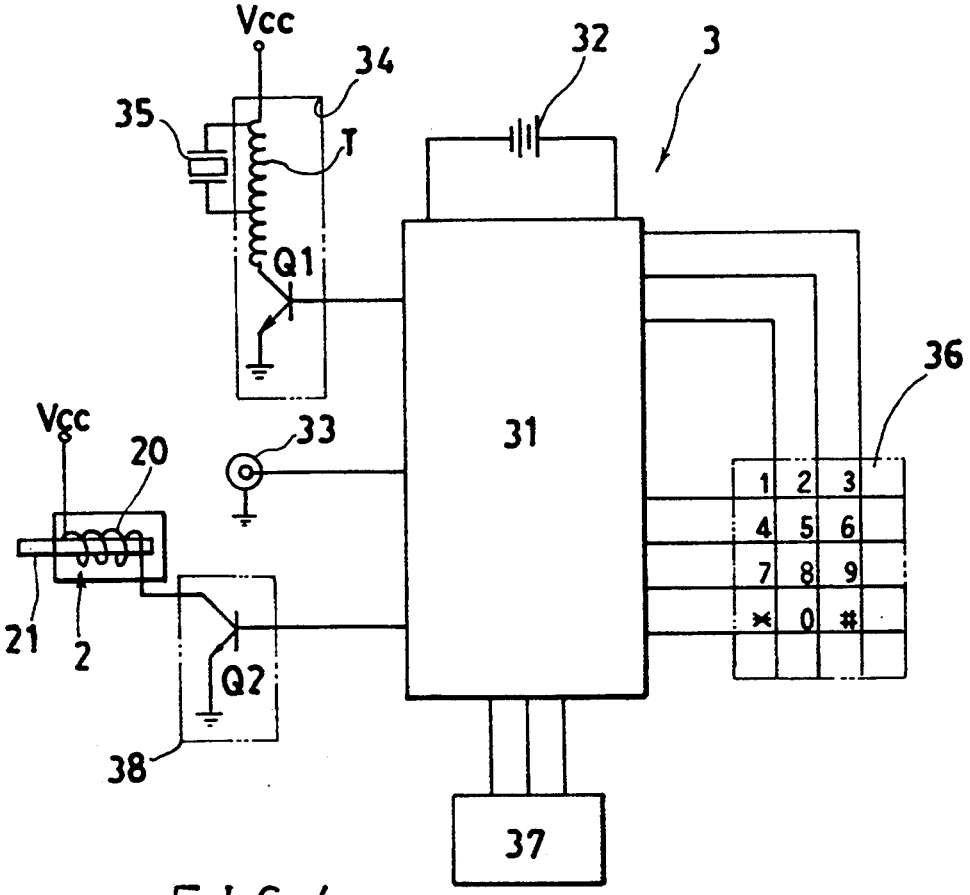
FIG. 4 shows an electronic circuit diagram of the present invention.

The alarm and control means 3 includes: a microprocessor 31 for executing alarming, unlocking, storing and setting operations; a power source 32 which may be a battery or batteries stored in the casing 10 for powering the elements of the alarm and control means 3; a motion sensor 33 which may be a spring switch or other sensors capable of producing a voltage signal when vibrating or moving the lock body 1 of the present invention for triggering an alarm 35 which may be a buzzer electrically connected to the microprocessor 31 through an alarm driver 34 which may include a transistor Q1 and a transformer T for amplifying the current and voltage for producing audible alarm sounding as shown in FIG. 4; a keyboard 36 electrically connected to the microprocessor 31 for keying in a pre-set or a re-set combination data into the microprocessor 31 for unlocking the locking device 2; a default code set 37 for preliminarily inputing unlocking combination data into the microprocessor 31 capable of continuously maintaining the manipulation of the microprocessor when power failure is caused and the batteries are to be renewed; and a solenoid driver 38 including a transistor Q2 electrically connected to the microprocessor 31 and connected to the solenoid switch 20 of the locking device 2, whereby upon keying in the correct unlocking combination into the microprocessor 31 to output unlocking signal to the solenoid driver 38 to be amplified by the solenoid driver 38 to energize the solenoid switch 20 to electromagnetically attract the latch 21 to unlock the shackle 13 to open the movable jaw portion The alarm 35 may be controlled by the microprocessor 31 for a predetermined alarming duration and a time delay period from actuating the sensor 33 until the alarm sounding. The microproessor 31 may receive the input signals, process the signals, and output relevant signals for executing plural operational modes in this invention.

The re-setting data such as for changing the unlocking combination of the locking device 2 may be keyed in, by depressing the relevant keys of the keyboard 36 of the alarm and control means 3, to be stored in the microprocessor 31.

Figure 5:
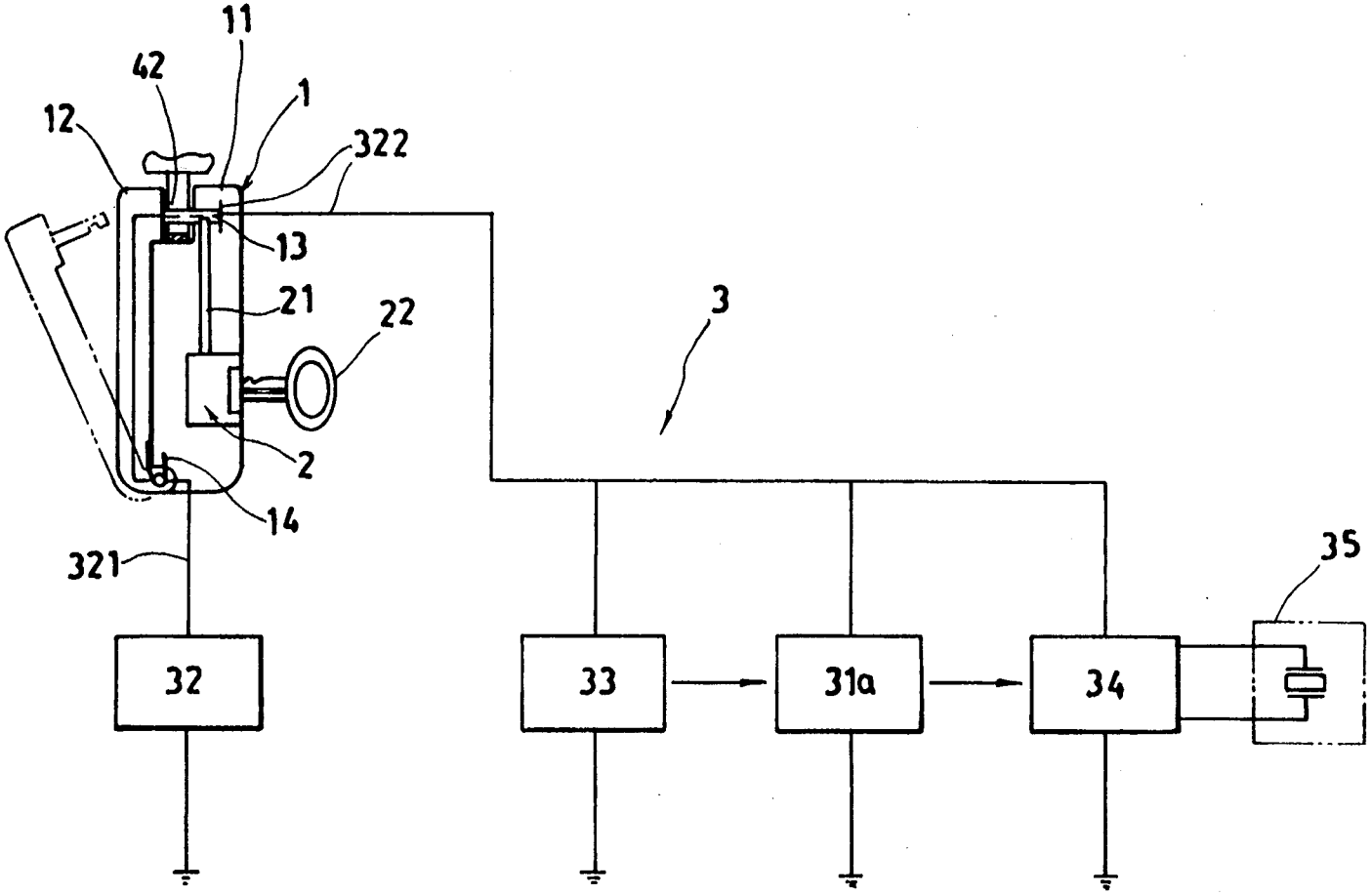
FIG. 5 shows another preferred electronic circuit diagram in accordance with the present invention.

The locking device 2 may be modified to include: a locking mechanism 20 of mechanical combination lock or a key-operated lock and a latch 21 connected to the locking mechanism 20 and engageable with the shackle 13 on the movable jaw portion 12, whereby upon opening by rotating a correct unlocking combination or by inserting a key 22 in the locking mechanism as shown in FIG. 5, the latch 21 can be retracted to unlock the shackle 13 and the movable jaw portion 12 for opening the locking device 2.

As shown in FIG. 5, the alarm and control means 3 of the present invention has been modified to include: a power source 32 electrically connected to an alarm and delay circuit 31*a*, a motion sensor 33, and an alarm driver 34 of the alarm 35 through two contactors 321, 322, of which the first contactor 321 is electrically connected between the first pole of the power source 32, and the movable jaw portion 12 and the shackle 13 and the second contactor 322 is secured to the fixed jaw portion 11 to be connectable to the first contactor 321. When the movable jaw portion 12 is closed to the fixed jaw portion 11 for locking the lock body on the trigger guard 42, and connected to the alarm and delay circuit 31*a*, the motion sensor 33 and the alarm driver 34 of the alarm 35, whereby upon unlocking of the locking device to open the lock body 1, the two contactors 321, 322 will be disconnected to de-energize the alarm and delay circuit 31*a* without sounding the alarm 35.

Other modifications may be made by those skilled in the art. For instance, the disconnection of the alarm and delay circuit 31*a* from the power source 32 may be obtained by a disengaging mechanism (not shown) provided at the locking mechanism 20 so that the alarm circuit will be de-energized when unlocking the locking mechanism 20 such as when opened by an insertion of key therein.

The present invention may be modified without departing from the spirit and scope of this invention.

I claim:

1. A handgun lock and alarm means comprising: a lock body having a shackle hung on a trigger guard of a handgun and shielding a trigger defined in the trigger guard of the handgun;

a locking device having a locking mechanism mounted in the lock body and having a latch held in said locking mechanism to be engagable with the shackle of the lock body for locking the lock body to be hanged on said handgun; and an alarm and control means having an alarm secured on said lock body and having a motion sensor operatively triggering the alarm when moving said lock body, for warning purposes, wherein upon actuation of said alarm and control means to unlock said locking device, said shackle of said lock body can be opened for triggering use.

2. A handgun lock and alarm means according to claim 1, wherein said lock body includes:

a fixed jaw portion protruding upwardly from a casing having the locking device and the alarm and control means stored in the casing;

a movable jaw portion pivotally connected to the casing by a pivot and protruding upwardly from the casing to be juxtapositional to the fixed jaw portion;

said shackle protruding transversely from the movable jaw portion to be inserted into a shackle hole recessed in the fixed jaw portion by passing the shackle through an opening in the trigger guard of the handgun and beyond the trigger for hanging the shackle and the lock body on the trigger guard;

a socket recessed and defined between the fixed jaw portion and the movable jaw portion and engaging with the trigger guard to allow the fixed jaw portion and the movable jaw portion to shield the trigger guard and the trigger of the handgun for preventing unwanted accidental actuation of the trigger for safety purposes;

a tension spring retained in the shackle hole in the fixed jaw portion for tensioning the shackle sideways and for helping the opening of the movable jaw portion when unlocking the locking device;

a limiting stem protruding transversely from the fixed jaw portion towards the movable jaw portion and positioned at an outer end portion of the lock body adjacent to a barrel of the handgun to retard a front end portion of the trigger guard for preventing a forward sliding movement of the lock body, from unshielding of the trigger, and for precluding intrusion of a person's finger into the trigger guard;

and a rear block portion formed on a rear end portion of the casing to be retained against a handgrip of the handgun to retard a rearward movement of the lock body to prevent an unwanted triggering of the shackle on the trigger for safety purposes.

3. A handgun lock and alarm means according to claim 2, wherein said locking device includes:

a locking mechanism which is a solenoid switch electrically connected to the alarm and control means and mounted in the casing of the lock body, whereby said latch reciprocatively held in the locking mechanism and having a latch end engageable with a shackle notch recessed in the shackle for locking the shackle with the latch for closing the movable jaw portion to the fixed jaw portion of the lock body for shielding the trigger and trigger guard of the handgun, whereby upon energizing of the solenoid switch, the latch will be electromagnetically attracted downwardly to disengage the latch end from the shackle notch and the tension spring will bias the shackle to open the movable jaw portion for unlocking the handgun for possible triggering use.

4. A handgun lock and alarm means according to claim 3, wherein said alarm and control means includes:

a microprocessor;

a motion sensor for producing a voltage signal when moving the lock body and for triggering an alarm electrically connected to the microprocessor for producing an audible alarm sound;

a keyboard electrically connected to the microprocessor for keying in a pre-set or a re-set combination data into the microprocessor for unlocking the locking device;

a default code set for inputing unlocking combination data into the microprocessor; and a power source for powering said microprocessor, said alarm, and said solenoid switch, with said microprocessor having an output connected to said solenoid switch of said locking device, whereby upon keying in a correct unlocking combination into the microprocessor to output an unlocking signal to the solenoid switch, the latch will be electromagnetically attracted to unlock the shackle to open the movable jaw portion.

5. A handgun lock and alarm means according to claim 2, wherein said locking device includes: a locking mechanism of a mechanical lock type selected from a key operated lock and a combination lock A and a latch connected to the locking mechanism and engageable with the shackle on the movable jaw portion, whereby upon unlocking of the locking mechanism, the latch can be retracted to unlock the shackle and the movable jaw portion for opening the locking device.

6. A handgun lock and alarm means according to claim 2, wherein said alarm and control means includes: a power source electrically connected to an alarm and delay circuit; a motion sensor; and an alarm through a first and a second contactor, of which the first contactor is electrically connected between the first pole of the power source, the movable jaw portion and the shackle, and the second contactor is secured to the fixed jaw portion to be connectable to the first contactor when the movable jaw portion is closed to the fixed jaw portion for locking the lock body on the trigger guard and connected to the alarm and delay circuit, the motion sensor and the alarm, whereby upon unlocking of the locking device to open the lock body, the two contactors will be disconnected to de-energize the alarm and delay circuit without actuating the alarm.

* * * * *